US005445591A

United States Patent [19]

Fougere

[11] Patent Number: 5,445,591

[45] Date of Patent: Aug. 29, 1995

[54] FOLDING TOOL

[76] Inventor: Joseph K. Fougere, P.O. Box 159, Sunset, Me. 04683

[21] Appl. No.: 264,958

[22] Filed: Jun. 24, 1994

[51] Int. Cl.[6] ..... B65H 45/22; B65H 45/09

[52] U.S. Cl. ..... 493/439; 493/468

[58] Field of Search ..... 493/408, 468, 439, 472, 493/480

[56] References Cited

U.S. PATENT DOCUMENTS 124,968 3/1872 Moschcowitz ..... 493/468
733,700 7/1903 Cohen ..... 493/439
792,870 6/1905 Wright ..... 493/439
2,400,698 5/1946 Lissa ..... 493/439
2,997,296 8/1961 Bash ..... 493/439
4,579,552 4/1986 Brannlund ..... 439/439

*Primary Examiner*—Jack W. Lavinder
*Attorney, Agent, or Firm*—Frederick R. Cantor

[57] ABSTRACT

A tool to fold a strip material to fit a 90 degree corner by providing a block with an interior slot to fold the strip material as it is pulled through the block.

1 Claim, 2 Drawing Sheets

FOLDING TOOL

BACKGROUND OF THE INVENTION

The present invention relates to a tool for creasing and folding material such as paper drywall interior and exterior corner seams.

The present invention was registered in the U.S Patent and Trademark Office Disclosure Document Program on Oct. 19, 1993 as U.S. Pat. Ser. No. 329761 with the title of "Kressa".

PRIOR ART

In the construction of walls using gypsum and paper panels also known as drywall, it is customary to reinforce the wall joints with a narrow sheet material known as seam paper. This is no problem on flat wall joints but when an inside or outside corner joint is encountered, it requires that the narrow sheet material known as seam paper be bent to fit a 90 degree angle. Seam paper normally comes in rolls about 2⅛" wide. Creasing and folding the seam paper is frequently done by hand which is a time consuming project.

It is also possible to purchase seam paper with a reinforcing metal back, which this tool also creases and folds to fit a 90 degrees wall angle.

This tool can also be used to apply the seam paper directly to a drywall corner, or used to crease and fold any length of seam paper desired to be cut and stored for later use.

SUMMARY OF THE INVENTION

The present invention relates to a tool for folding strip goods in their center. It is an object of this invention to provide a tool to quickly crease and fold lengths of strip sheet material of various dimensions in width.

It is a further object of the present invention to produce a tool which will fold drywall seam paper in the center to make the paper suitable for taping drywall inside and outside corners.

SPECIFIC DESCRIPTION OF THE PREFERRED EMBODIMENT

Figure 2:
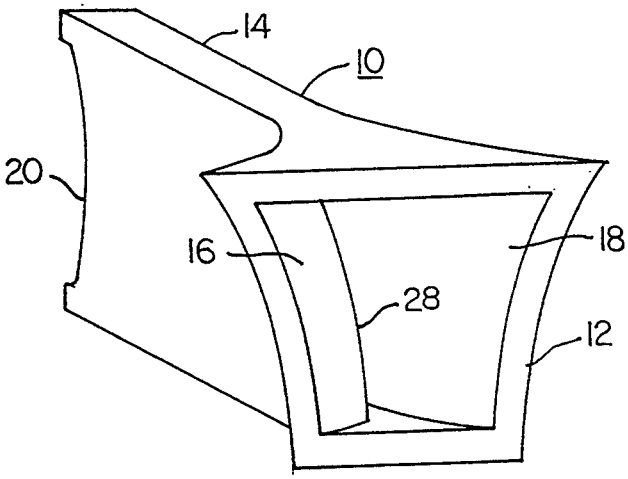
FIG. 2 is an end view of the feeding end of the FIG. 1 tool.
Figure 3:
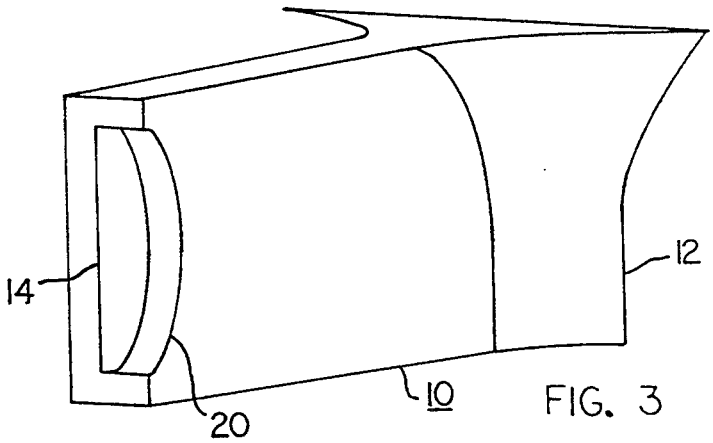
FIG. 3 is an end view of the discharge end of the present invention.
Figure 5:
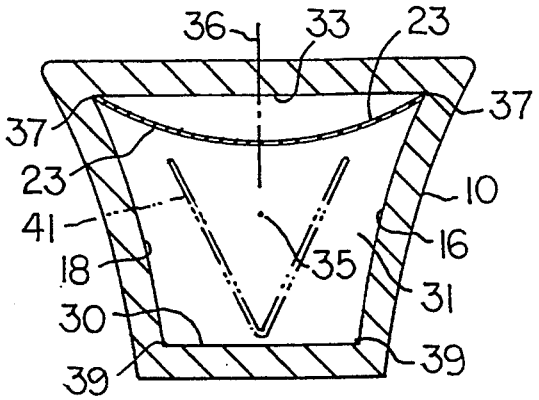
FIGS. 5 through 9 are transverse sectional views taken respectively on lines 5—5, 6—6, 7—7, 8—8, and 9—9 in FIG. 4.
Figure 7:
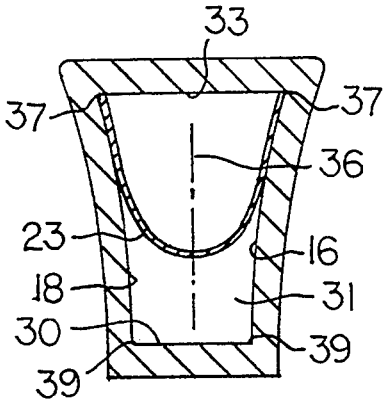

With reference to the figures where like numerals refer to like parts, the present invention is generally designated by the reference numeral 10, having a large intake or paper feeding opening 12, shown in FIG. 2 and a small discharge or folded paper output opening 14 as seen in FIG. 3. The tool flared intake opening 12 of FIG. 2 a first curved surface 16 and a second oppositely disposed curved surface 18.

Figure 1:
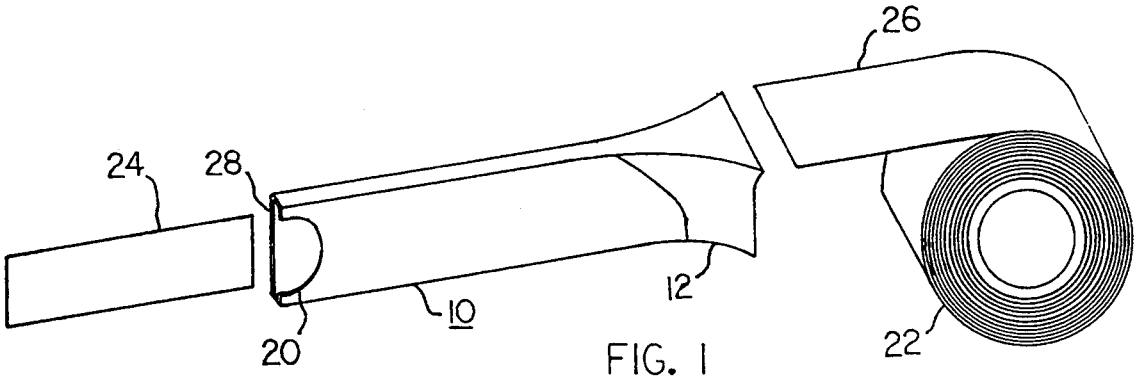
FIG. 1 is a side elevation of a tool embodying the present invention, and showing a roll of tape arranged for feeding into a passageway extending within the tool.

These two curved surfaces are separated by a narrow rectangular slot 28. A flat bottom surface 30 is provided in the opening 12 to receive the paper strip 26. In FIG. 1 it will be observed that the left end of the tool has a thumb notch 20 at the discharge end 14 of the tool 10. The function of this thumb notch 20 will be detailed later in relation to the operation of my tool. In FIG. 1 one may see a seam paper roll 22. The seam paper is shown flat 26 as it enters the tool 10 and folded or creased 24 as it emerges from the left hand or the output end 14 of the tool 10. In FIG. 1 you may see the narrow slot 28 which is the folded paper discharge end of the invention 10. In practice, I have found the best width of this slot to be about 0.05".

Narrow slot 28 forms the downstream section of a passageway 31 that extends between the intake opening 12 of the tool and the discharge opening 14. The upstream section of passageway 31 is defined generally by the internal curved side surfaces 16 and 18. The downstream section of passageway 31 has generally parallel wall surfaces that define slot 28.

The upstream section of passageway 31 comprises a flat roof surface 33 and the aforementioned flat bottom (floor) surface 30. The upstream passage section further comprises the convergent curved side surfaces 16 and 18.

The longitudinal passageway 31 has a longitudinal axis 35 located midway between roof surface 33 and floor surface 30. The passageway has an imaginary vertical mid-plane 36 coincident with axis 35 midway between the internal side surfaces of the passageway.

The flat roof surface 33 intersects side surfaces 16 and 18 to form two upper internal passage corners 37 extending the length of passageway 31. The flat floor surface 30 intersects side surfaces 16 and 18 to form two lower internal passage corners 39 extending the length of passageway 31.

Figure 4:
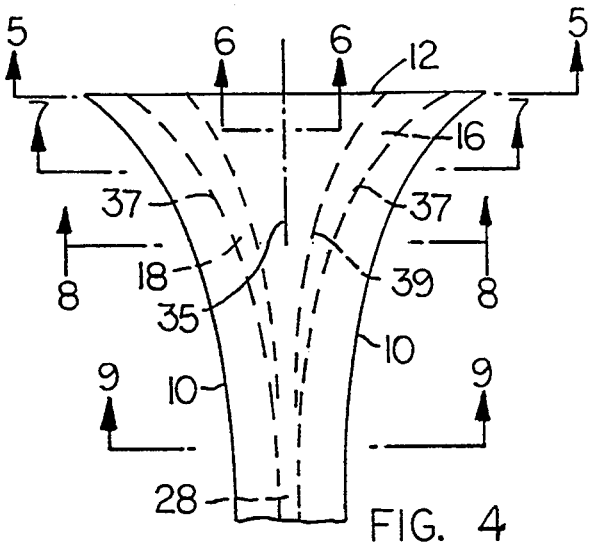
FIG. 4 is a fragmentary top plan view of the FIG. 1 tool, showing the intake end thereof.
Figure 8:
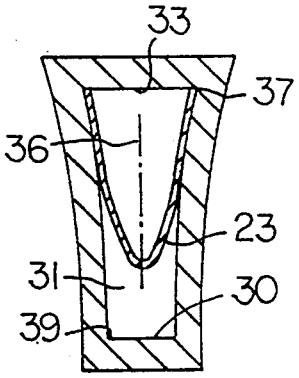
Figure 6:
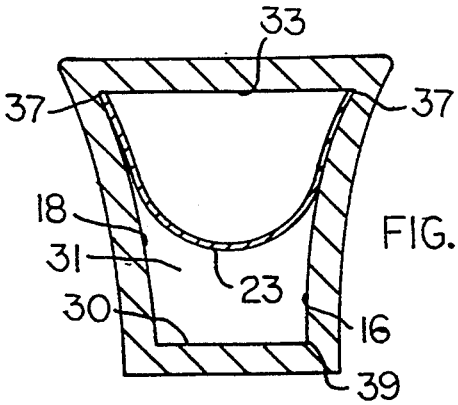

In the upstream section of passageway 31 the upper and lower corners 37 and 39 are convexly curved, as shown in FIG. 4. In the downstream section of passageway 31 the various passage surfaces are flat and parallel so that the corners of the passageway are straight and parallel. The surfaces of the two passage sections merge smoothly together to form a continuous uninterrupted passageway.

In the upstream section of passageway 31 the side surfaces 16 and 18 are convexly curved in horizontal planes parallel to longitudinal axis 35, as shown in FIG. 4. Side surfaces 16 and 18 are also convexly curved in vertical planes normal to the longitudinal vertical mid-plane 36, as can be seen from FIGS. 1 and 5 through 8.

The side surface curvatures are such that each curved side surface 16 or 18 is convergent in a direction from roof surface 33 to floor surface 30. This vertical convergence is visible in FIGS. 2 and 5 through 8.

Figure 9:
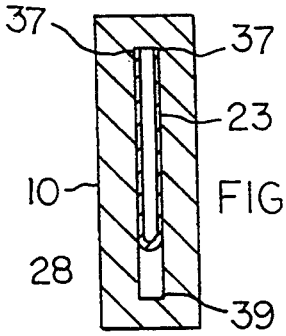

The vertical convergence of side surfaces 16 and 18 causes the upper internal corners 37 of the convergent passage section to be spaced further apart than the corresponding lower internal corners 39. The curved side surfaces 16 and 18 thereby act as cam surfaces to bias the paper strip 23 upwardly so that its longitudinal side edges ride against the upper internal corners 37. The convergence of the curved corners 37 (depicted in FIG. 4) causes the paper strip to be smoothly folded to a U-configuration, as depicted in FIG. 9.

OPERATION

In operation, as best seen in FIG. 1, a little of the flat seam paper 26 is unwound from the roll 22 and inserted in the right or input end 12 of the tool 10

The leading end portion of the paper strip is folded by hand to form a longitudinal crease in the paper strip. The paper strip is then inserted into the intake opening 12 of the tool passageway, with the hand-folded crease placed on the bottom 30 of the opening 12. The paper 26 is hand pushed through the slot 28 of the tool 10 from the right hand input or opening 12 of the tool. The paper strip 26 is pushed through the slot 28 until it emerges from the left or the small end 14 of the tool 10 where the thumb notch 20 is used to pull the now folded paper strip 26 out through the left side 14 of the tool 10. The paper strip 26 may now be pulled rapidly off the roll 22 and through the tool 10. In this manner, a long strip of folded corner reinforcing paper 24 may be produced for drywall interior or exterior corner work in a rapid manner.

FIGS. 5 through 9, illustrate the condition of the paper strip 23 as it moves through the longitudinal passageway 31. The hand-folded crease in the leading end of the paper will initially give the strip a "V" configuration as show in dotted lines at 41 in FIG. 5. However, as the strip is pulled through the passageway, the follow-on sections of the strip will have a curved cross-section, as shown at 23 in FIGS. 5 through 8. FIG. 9 depicts the final folded condition produced by slot 28 (the downstream section of passageway 31).

It will be noted that the side surfaces 16 and 18 are curved in two planes, i.e., vertically as shown in FIGS. 5 through 8, and horizontally as shown in FIG. 4. The surface curvature is such that surfaces 16 and 18 bias the paper strip upwardly so that its side edges ride in upper corners 37. The fold, or crease, in the paper is thereby centered on the paper strip for the entire length of the strip.

The curvatures on side surfaces 16 and 18 also ensure that the folding action will be continuous and uninterrupted. The paper will be deformed gradually from the FIG. 5 condition to the FIG. 9 condition, without interruption or break in the fold line.

Of course, various changes, modifications and alterations in the teachings of the present invention may be contemplated by those skilled in the art without departing from the intended spirit and scope thereof.

I claim as my invention:

1. A tool for folding a drywall paper strip on a longitudinal fold line parallel to the strip side edges, said tool comprising:

a rigid elongated tool body (10) having a longitudinal passageway extending there through;

said passageway having an intake end and a discharge end;

said longitudinal passageway having a flat roof surface, floor surface (30) parallel to said roof surface, and two side surfaces (16, 18) extending between said roof surface and said floor surface;

said flat roof surface intersecting each side surface to form two upper internal corners extending along the passageway;

said floor surface intersecting each side surface to form two lower internal corners extending along the passageway;

said passageway having a longitudinal axis, and a longitudinal vertical midplane coincident with said axis;

said longitudinal passageway comprising an upstream passage section and a downstream passage section, wherein the surfaces thereof merge smoothly together to form a continuous uninterrupted passageway;

the side surfaces of the upstream passage section being convexly curved in vertical planes normal to the longitudinal vertical midplane;

the side surfaces of the upstream passage section being convexly curved in horizontal planes parallel to the passageway longitudinal axis;

the side surface curvatures being such that the upstream passage section is convergent from the intake end of the passageway to the downstream passage section;

the side surfaces of the upstream passage section being convergent from the roof surface to the floor surface, whereby the upper internal corners of the upstream passage section are spaced further apart than the lower internal corners of the upstream passage section, measured in planes normal to the longitudinal axis; and the upper and lower internal corners of the upsteam passage section being curved, and the upper and lower internal corners of the downstream passage section being straight and parallel, whereby when a paper strip is pulled through the passageway the curved side surfaces of the upstream passage section bias the paper strip so that its longitudinal side edges ride against the upper internal corners of the passageway.

* * * * *